US006588771B2

(12) United States Patent
Olson et al.

(10) Patent No.: US 6,588,771 B2
(45) **Date of Patent: *Jul. 8, 2003**

(54) ADJUSTABLE FIT IN-LINE SKATE

(75) Inventors: Todd Jack Olson, Chanhassen, MN (US); Thomas Lee Spaulding, St. Louis Park, MN (US); Alan Eugene Doop, Delano, MN (US)

(73) Assignee: Benetton Sportsystem USA, Inc., Bordentown, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/167,313

(22) Filed: Jun. 11, 2002

(65) Prior Publication Data

US 2002/0153679 A1 Oct. 24, 2002

Related U.S. Application Data

(63) Continuation of application No. 09/531,797, filed on Mar. 21, 2000, now Pat. No. 6,471,219, which is a continuation of application No. 09/264,548, filed on Mar. 8, 1999, now Pat. No. 6,050,574, which is a continuation of application No. 08/908,863, filed on Aug. 8, 1997, now Pat. No. 5,913,526, which is a continuation of application No. 08/477,181, filed on Jun. 7, 1995, now Pat. No. 5,678,833.

(51) Int. Cl.[7] ..... A63C 17/06
(52) U.S. Cl. ..... 280/11.221; 280/11.26
(58) Field of Search ..... 280/11.221, 11.231, 280/11.224, 11.26, 11.3, 11.19, 11.27, 11.28, 841; 36/97, 102, 115

(56) References Cited

U.S. PATENT DOCUMENTS

| | | | |
|---|---|---|---|
| 163,171 | A | 5/1875 | Evans |
| 272,470 | A | 2/1883 | Pond |
| 536,345 | A | 3/1895 | Harris |

(List continued on next page.)

FOREIGN PATENT DOCUMENTS

| | | |
|---|---|---|
| CA | 1321066 | 8/1993 |
| CA | 2185497 | 7/1997 |
| DE | 597644 | 1/1933 |
| DE | 2749887 | 8/1978 |
| DE | 2800626 | 7/1979 |
| DE | 3212933 | 10/1983 |
| DE | 3835035 | 7/1989 |
| EP | 0053340 | 11/1981 |
| EP | 0215744 | 3/1987 |
| EP | 0356398 | 2/1990 |
| EP | 443293 A1 | 2/1990 |
| EP | 551704 | 7/1993 |
| EP | 610652 | 8/1994 |
| FR | 1266620 | 6/1961 |
| FR | 2448362 | 9/1980 |
| FR | 2515053 | 4/1983 |
| FR | 2520242 | 7/1983 |
| FR | 2561115 | 9/1985 |

(List continued on next page.)

OTHER PUBLICATIONS

Promotional literature of Roces, Inc. showing Roadskates® in–line skate.
PCT International Publication No. WO92/09340 published Jun. 11, 1992.
PCT International Publication No. WO80/02789 published Dec. 24, 1980.
German Publication GMA–HEFT 48VOM, dated Nov. 27, 1980, p. 1815.
International Search Report EP 00 20 3670, Aug. 14, 2001.

*Primary Examiner*—Paul N. Dickson
*Assistant Examiner*—David R. Dunn
(74) *Attorney, Agent, or Firm*—Fish & Richardson P.C.

(57) ABSTRACT

An adjustable fit in-line skate is disclosed having a rigid frame carrying a plurality of skate wheels. A boot is secured to the frame with the boot having a toe portion and a heel portion. The heel portion has a sole plate which is carried over the length of the frame. The toe portion receives the sole plate and is slidably attached to the heel portion.

21 Claims, 8 Drawing Sheets

U.S. PATENT DOCUMENTS 641,642 A 1/1900 Gunn
766,101 A 7/1904 Croner
797,966 A 8/1905 Lange et al.
831,210 A 9/1906 Bosley
1,104,357 A 7/1914 Hassel
1,136,474 A 4/1915 McCamish
1,279,891 A 9/1918 McCamish
1,633,413 A 6/1927 La Marca
1,844,885 A 2/1932 Harris
1,895,270 A 1/1933 Siragusa
2,009,684 A 7/1935 Affronte
2,050,535 A 8/1936 Martel
2,059,747 A 11/1936 Roberts
2,112,052 A 3/1938 Smith
2,149,139 A 2/1939 Geuting
2,207,306 A 7/1940 Taaler
2,252,315 A * 8/1941 Doree ..... 36/102
2,391,720 A 12/1945 Ludwig
2,400,692 A 5/1946 Herbert
2,402,726 A 6/1946 Bonyhady
2,428,262 A 9/1947 Bunker
2,497,175 A 2/1950 Mantos
2,522,505 A 9/1950 Ferris
2,523,449 A 9/1950 Rosenzweig
2,572,050 A 10/1951 Ornstein
2,603,889 A 7/1952 Lahnstein et al.
2,734,284 A 2/1956 Seurbom
2,745,196 A 5/1956 Schneider et al.
2,746,177 A 5/1956 Maccarone
2,756,518 A 7/1956 Raney
2,904,902 A 9/1959 Murray
2,926,433 A 3/1960 Kramer
2,934,839 A 5/1960 Servin
3,007,706 A * 11/1961 Pullen ..... 280/11.26
3,013,564 A 12/1961 Levey
3,027,658 A 4/1962 Rigsby
3,045,367 A 7/1962 McKeon
3,052,046 A 9/1962 Kramer
3,057,085 A 10/1962 Rigsby
3,057,086 A 10/1962 Rigsby
3,058,241 A 10/1962 Rigsby
3,142,911 A 8/1964 Waters
3,229,989 A 1/1966 Papangulis
3,372,495 A 3/1968 Finn
3,389,481 A 6/1968 England
3,404,468 A 10/1968 Rosen
3,431,658 A 3/1969 Finn
3,497,875 A 3/1970 Rivera
3,541,708 A 11/1970 Rosen
3,645,017 A 2/1972 Hickmann
3,686,777 A 8/1972 Rosen
3,705,463 A 12/1972 Lown
3,744,163 A 7/1973 Simister
3,748,756 A 7/1973 White
3,858,337 A 1/1975 Vogel
3,895,452 A 7/1975 Hanson et al.
3,922,800 A 12/1975 Miller et al.
3,963,252 A 6/1976 Carlson
3,977,098 A 8/1976 Chalmers
4,058,324 A 11/1977 Dallaire
4,060,918 A 12/1977 Mandel
4,069,515 A 1/1978 Swallow et al.
4,083,128 A 4/1978 Rossman
4,120,103 A 10/1978 Colby
4,126,323 A 11/1978 Scherz
4,204,345 A 5/1980 Bradley
4,255,876 A 3/1981 Johnson
4,299,039 A 11/1981 Hanson
4,334,690 A 6/1982 Klamer et al.
4,354,319 A 10/1982 Block et al.
4,379,564 A 4/1983 Welker
4,385,456 A 5/1983 Livernois et al.
4,516,336 A 5/1985 Nissenbaum
4,523,392 A 6/1985 Gabrielli
4,538,368 A 9/1985 Mugford
4,554,749 A 11/1985 Ostrander
4,708,352 A 11/1987 Vullierme
4,724,627 A 2/1988 Sisco
4,736,531 A 4/1988 Richard
4,747,221 A 5/1988 Hayes
4,773,886 A 9/1988 Teeter et al.
4,788,780 A 12/1988 Boggs
D300,049 S 2/1989 Klammer et al.
4,839,972 A 6/1989 Pack et al.
RE33,018 E 8/1989 Ostrander
4,944,099 A 7/1990 Davis
4,959,914 A 10/1990 Hilgarth
4,998,358 A 3/1991 Girardelli
5,035,069 A 7/1991 Minden
5,046,746 A 9/1991 Gierveld
5,092,614 A 3/1992 Malewicz
D326,700 S 6/1992 Brown et al.
D333,171 S 2/1993 Gertler
5,184,834 A 2/1993 Yu
D337,805 S 7/1993 Rosso et al.
D341,863 S 11/1993 Cavasin
D342,113 S 12/1993 Cavasin
D344,316 S 2/1994 Gertler
D345,405 S 3/1994 Cavasin
D346,633 S 5/1994 Conte
D347,237 S 5/1994 Robjent et al.
5,357,695 A 10/1994 Lu
D353,429 S 12/1994 Gay et al.
5,394,624 A 3/1995 Siepser
5,397,141 A 3/1995 Hoshizaki et al.
5,404,657 A 4/1995 Honeycutt
5,449,183 A 9/1995 Klamer et al.
5,475,936 A 12/1995 Cavasin
5,484,149 A 1/1996 Lee
5,566,475 A 10/1996 Donnadieu
5,572,806 A 11/1996 Osawa
5,575,015 A 11/1996 Paris et al.
5,634,648 A 6/1997 Tonel et al.
5,645,288 A * 7/1997 Lu ..... 280/11.26
5,678,833 A * 10/1997 Olson et al. ..... 280/11.22
5,704,139 A 1/1998 Okajima
5,913,526 A * 6/1999 Olson et al. ..... 280/11.22
6,045,144 A * 4/2000 Wong ..... 280/11.26
6,050,574 A * 4/2000 Olson et al. ..... 280/11.22
6,471,219 B2 * 10/2002 Olson et al. ..... 280/11.231

FOREIGN PATENT DOCUMENTS

FR 2614547 11/1988
FR 2672812 A1 8/1992
GB 674292 6/1952
NL 7311611 8/1973
NL 8903154 12/1989
NL 9000384 2/1990
WO 92/18023 10/1992
WO 9414350 7/1994
WO WO 95/03101 2/1995

* cited by examiner

ADJUSTABLE FIT IN-LINE SKATE

This application is a continuation of U.S. application Ser. No. 09/531,797 filed Mar. 21, 2000 now U.S. Pat. No. 6,471,219, which is a continuation of U.S. application Ser. No. 09/264,548, filed Mar. 8, 1999, now U.S. Pat. No. 6,050,574, which is continuation of U.S. application Ser. No. 08/908,863, filed Aug. 8, 1997, now U.S. Pat. No. 5,913,526, which is a continuation of U.S. application No. 08/477,181, filed Jun. 7, 1995, now U.S. Pat. No. 5,678,833.

I. BACKGROUND OF THE INVENTION

1. Field of the Invention

This invention pertains to skates such as in-line skates and the like. More particularly, this invention pertains to such a skate which may accommodate a variety of shoe sizes.

2. Description of the Prior Art

In recent years, the sport of in-line skating has enjoyed a tremendous growth in popularity. In addition to being enjoyable exercise for adults, children have participated in in-line skating.

High quality in-line skates can be expensive. The expense is particularly frustrating for parents of young children. As the children grow, their foot sizes expand necessitating frequent replacement of footwear of any type including recreational footwear such as in-line skates.

In the past, in-line skate manufacturers have accommodated growth in foot size by having an oversized molded boot containing a replaceable liner. Liners of various wall thicknesses could be provided such that the liners could be replaced to accommodate different foot sizes. Alternatively, various techniques have been provided for permitting the boot of the skate to adjust to accommodate growth in foot size. However, such techniques have commonly been lacking in providing for a construction which is secure after adjustment and without impairing performance of the skate.

II. SUMMARY OF THE INVENTION

According to a preferred embodiment of the present invention, an adjustable fit in-line skate is provided having a rigid frame with a plurality of in-line skate wheels secured to the frame. A boot is secured to the frame with the boot having a toe portion and a heel portion. The heel portion includes a sole and the heel portion is fixed to the frame. The toe portion has a base and is fastened to the heel portion by means which releasably secure each of the base and the sole to at least a portion of the frame. The toe portion is slidable relative to the heel portion along a line of travel which is generally parallel to the longitudinal dimension of the skate. The toe portion may be fixed at any one of a plurality of fixed positions along the line of travel.

III. BRIEF DESCRIPTION OF THE DRAWINGS

IV. DESCRIPTION OF THE PREFERRED EMBODIMENT

Figure 2:
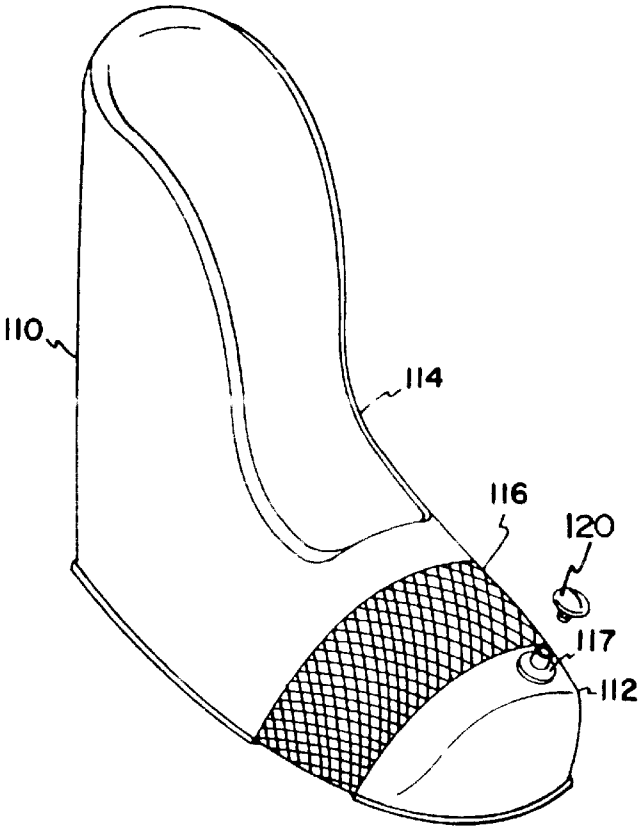
FIG. 2 is an exploded perspective view of a liner for use with the skate of FIG. 1.
Figure 1:
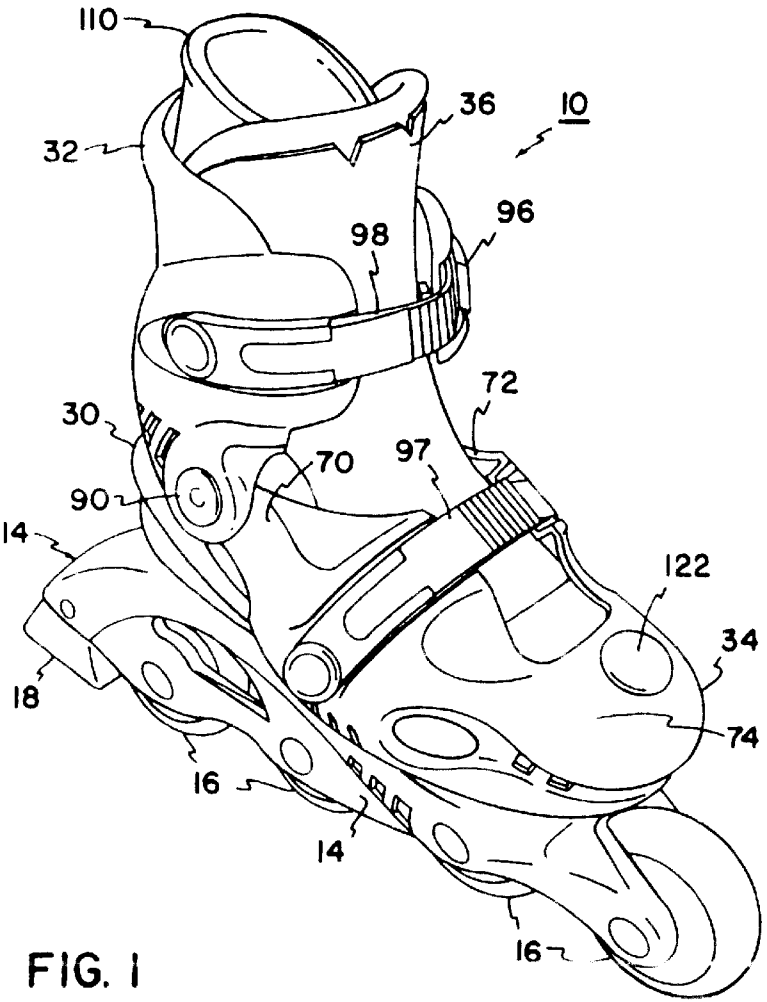
FIG. 1 is a front, right and top perspective view of the skate of the present invention.
Figure 3:
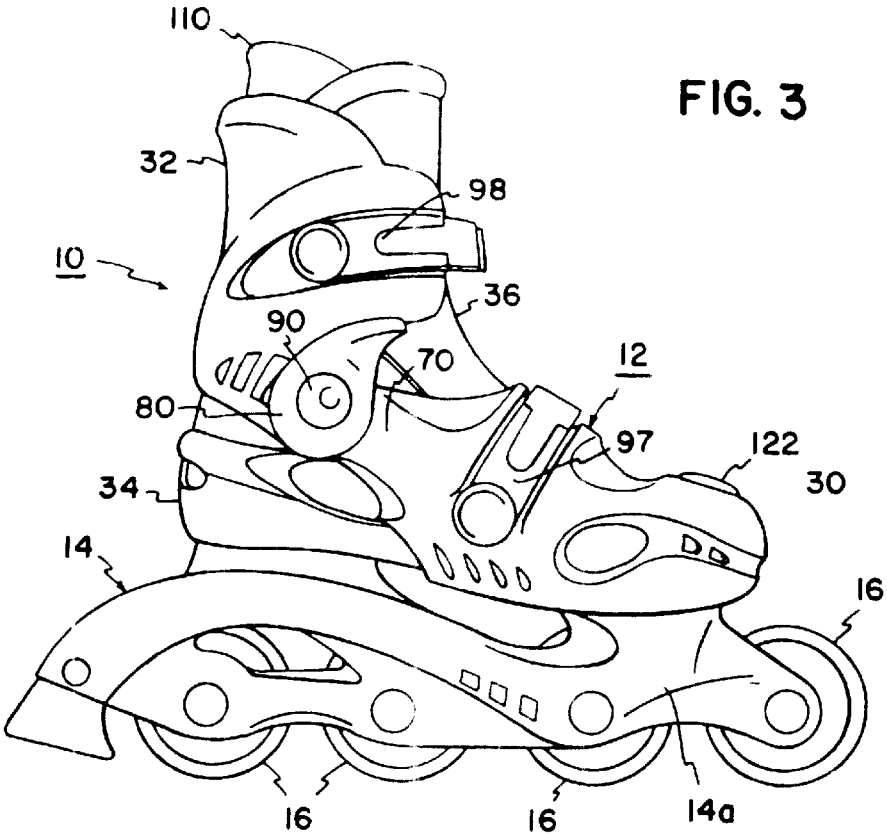
FIG. 3 is a right side elevation view of the skate of FIG. 1 shown adjusted to a minimum foot size adjustment.
Figure 4:
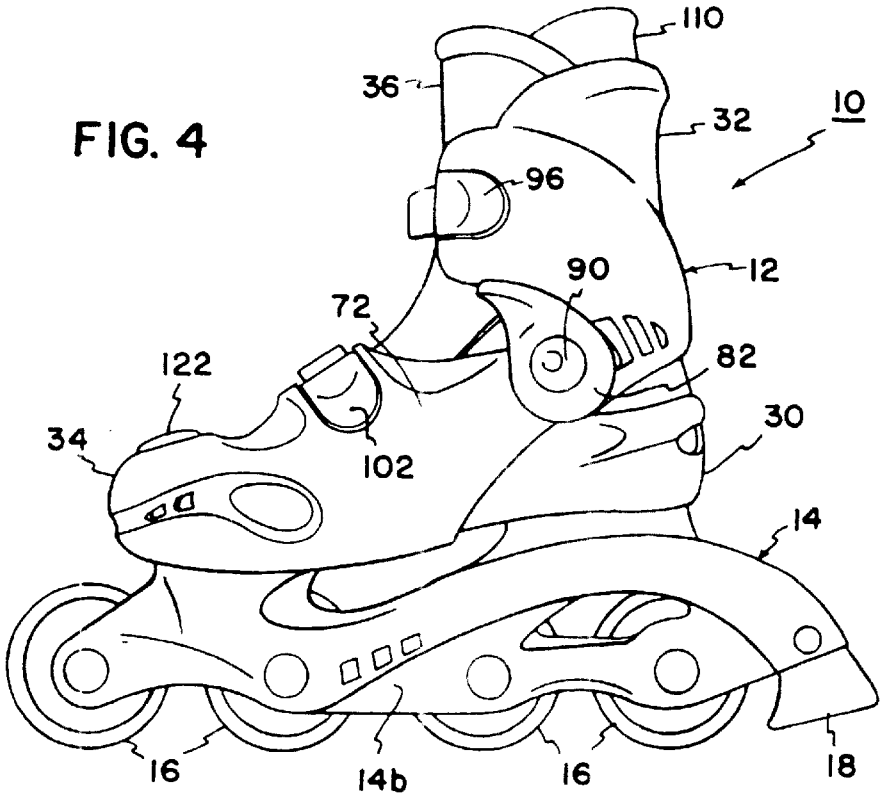
FIG. 4 is a left side elevation view of the skate of FIG. 1.
Figure 5:
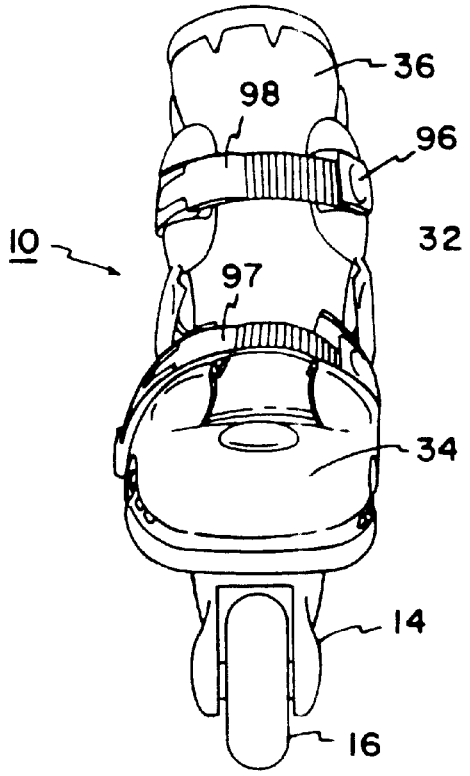
FIG. 5 is a front elevation view of the skate of FIG. 1.
Figure 6:
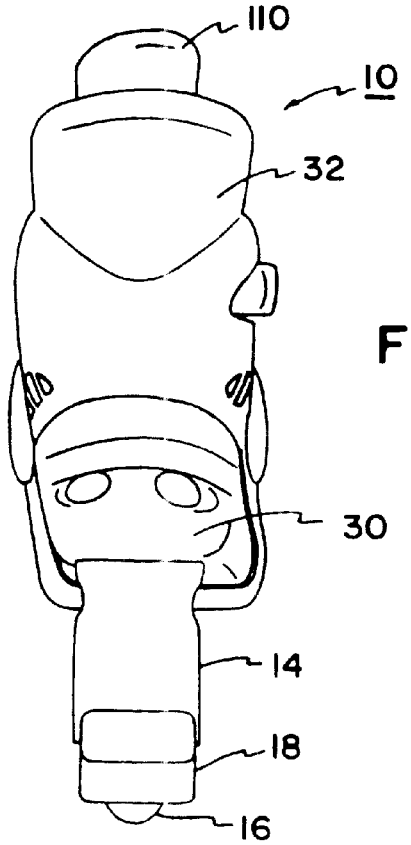
FIG. 6 is a rear elevation view of the skate of FIG. 1.
Figure 7:
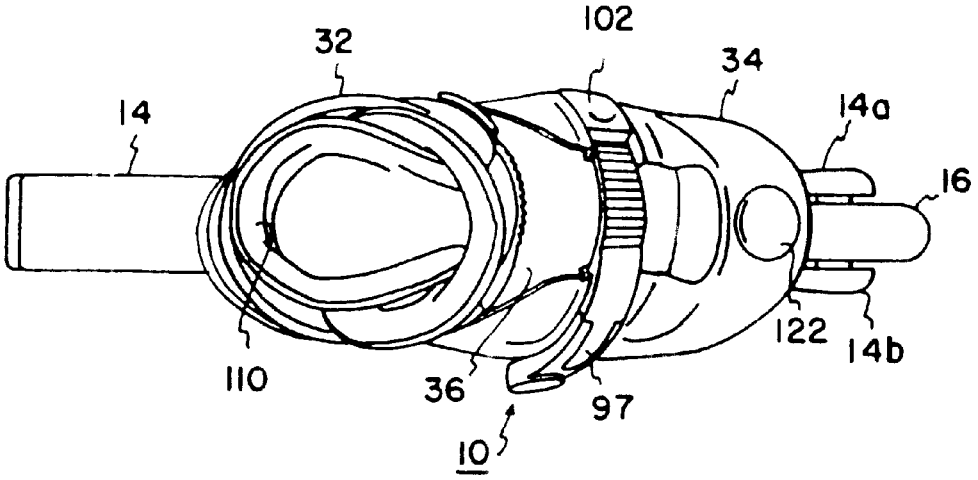
FIG. 7 is a top plan view of the skate of FIG. 1.

With reference now to the various drawing figures in which identical elements are numbered identically throughout, a description of the preferred embodiment of the present invention will now be provided.

In the various figures, an in-line skate 10 is illustrated having a skate boot 12 secured to a frame 14 and containing a liner 110. The frame 14 carries a plurality of wheels 16 which, in an in-line skate, are arranged in a line. Also, the frame carries a resilient brake pad 18 as is conventional.

Figure 11:
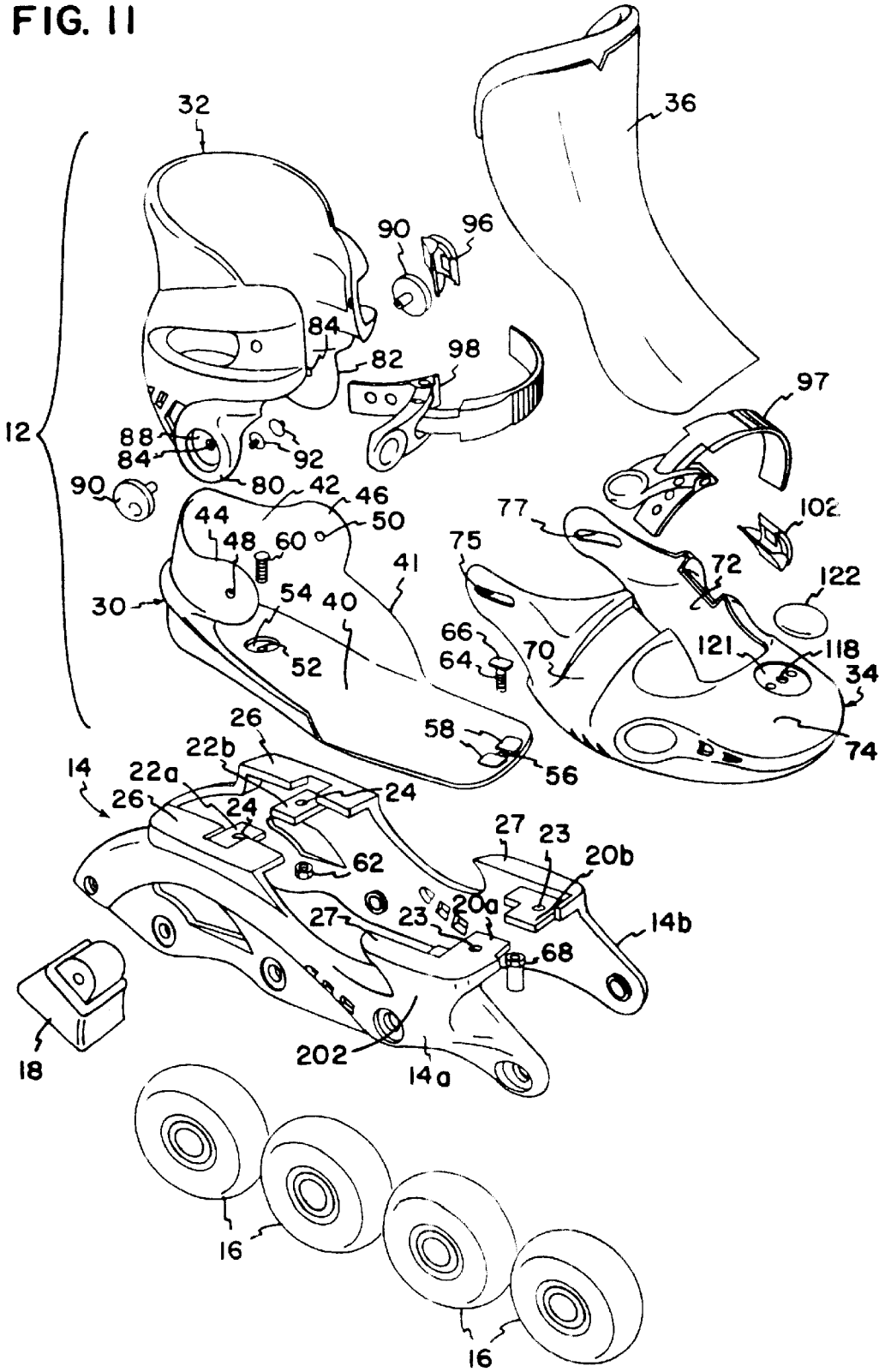
FIG. 11 is an exploded perspective view of the skate of FIG. 1 (without showing a liner)
Figure 12:
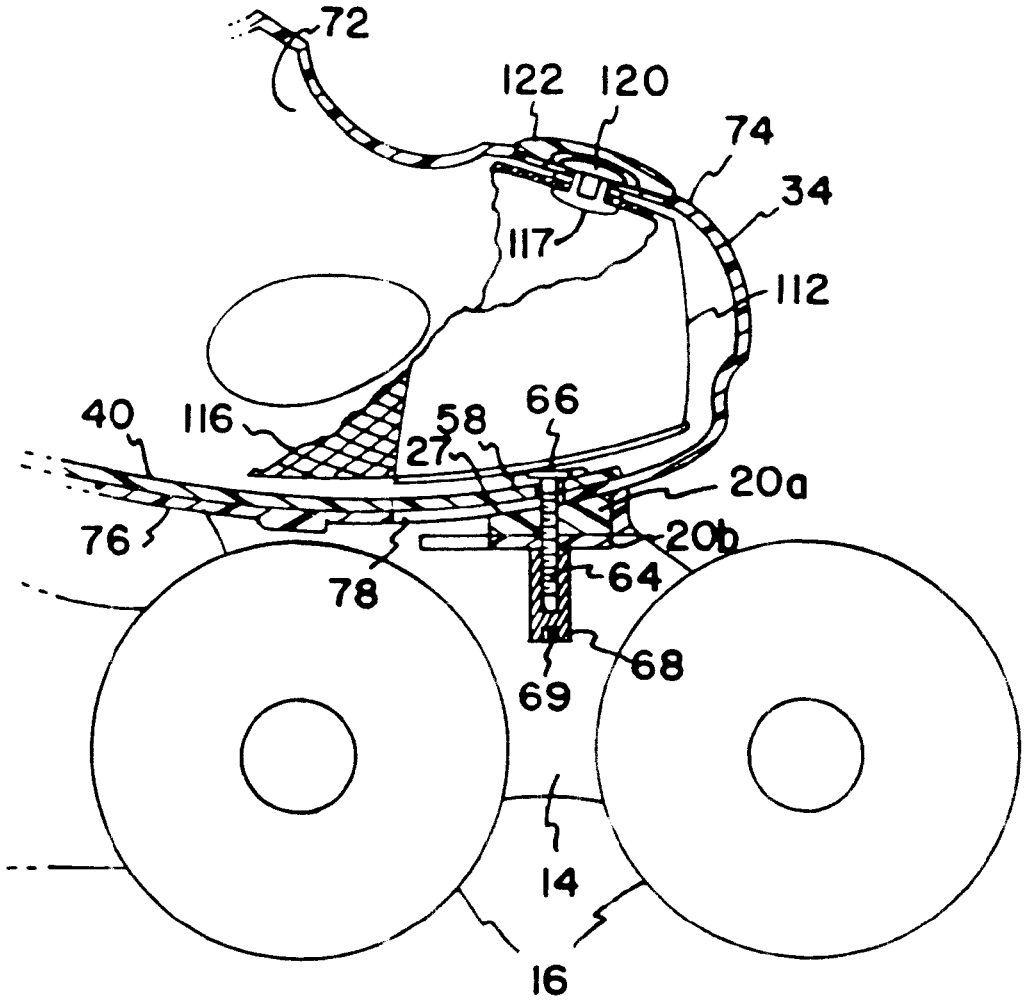
FIG. 12 is a side sectional view of a toe portion of the skate of FIG. 1.

Shown best in FIG. 11, the frame 14 includes two halves 14*a*, 14*b*. The frame halves 14*a*, 14*b* are slidably joined at offset and overlapping front tongues 20*a*, 20*b* (having holes 23) and rear tongues 22*a*, 22*b* (having holes 24). Holes 23 are in alignment when the halves 14*a*, 14*b* are joined. Holes 24 are similarly aligned when the halves 14*a*, 14*b* are joined. When the halves 14*a*, 14*b* are joined together, flat rear upper surfaces 26 of the halves 14*a*, 14*b* are in generally planar alignment to define a rear support platform. Upper surface 27 in the toe area of the frame defines a front support platform when the halves 14*a*, 14*b* are joined. As shown in FIG. 12, surfaces 27 are arcuate to mate with a base 76 to toe portion 34 as will be described.

Referring back to FIG. 11, the boot 12 includes a heel portion 30, cuff 32, toe portion 34 and tongue 36. The heel portion 30 includes a sole 40 and a raised heel wall 42 having sidewalls 44, 46 each with holes 48, 50. The heel wall 42 surrounds the heel and lower ankle of the wearer with wall 46 being raised on the inside of the foot to provide additional support 41 for the arch of the user.

The sole 40 includes a hole 52 formed in a recess 54 at a heel end of sole 40. Similarly, at a toe end of the sole 40, a hole 56 is provided between two ramped surfaces 58. The base or sole 40 is sized to rest on the rear support platform 26 and the front support platform 28 with hole 52 aligned with holes 24 and with hole 56 aligned with holes 23. A bolt 60 is sized to be passed through hole 52 with the head end of the bolt received within the recess 54 and with the bolt 60 further passing through holes 24 and secured by a nut 62. Similarly, a bolt 64 having a head 66 sized to be received between ramped surfaces 58 is provided with the bolt 64 passing through hole 56 and aligned holes 23 and received within an elongated nut 68. As can be seen, since holes 52, 56 are approximately equal to the diameter of bolts 60, 64, once the heel portion 30 is secured to the frame 14, the heel portion 30 is restricted from movement relative to the frame 14.

The toe portion 34 includes a toe box having sidewalls 70, 72 and a top wall 74. Further, as shown in FIG. 12, toe portion 34 has a bottom wall 76. The bottom wall 76 is provided with an elongated slot 78 extending in a longitudinal dimension of the skate to pass the bolt 64. When assembled with the heel portion 30, the toe portion 34 is provided with the base 76 in underlying relation relative to the sole 40 of the heel portion 30. Further, the sidewalls 70, 72 are positioned in overlying relation to the exterior surfaces of the sidewalls 44, 46 of the heel portion 30. The sidewalls 70, 72 are provided with elongated slots 75, 77 aligned with holes 48, 50, respectively. With the construction thus described, upon loosening of elongated nut 68 (by use of an Allen wrench received in hole 69—see FIG. 12), the toe portion 34 may move along a line of travel which is generally parallel to the longitudinal dimension of the skate. The slots 75, 77 are aligned such that throughout the path of travel, the slots 75, 77 remain aligned with holes 48, 50.

The cuff 32 is provided to surround an upper ankle area of the wearer and surrounding the heel portion 42 as well as the rearward ends of the sidewall 70, 72. The cuff 32 has at its lower end pivot locations 80, 82 having holes 84, 86 aligned with holes 48, 50. A recessed area 88 surrounds hole 84. Although not shown, an identical recessed area surrounds hole 86.

Figure 13:
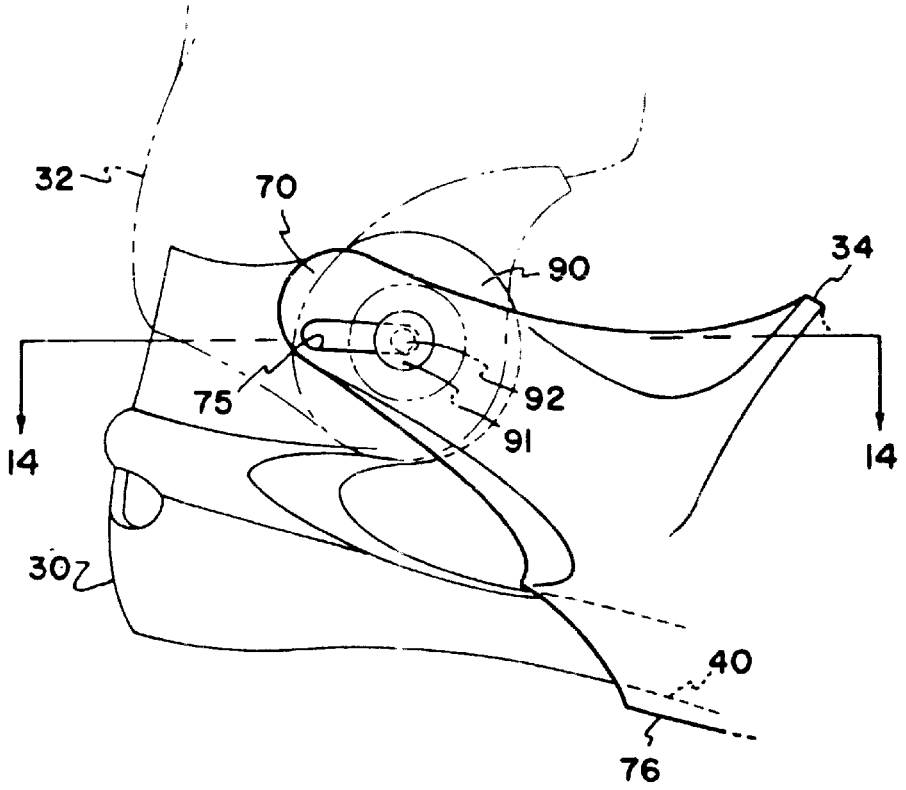
FIG. 13 is an enlarged view of a heel portion of the skate of FIG. 1 (with a cuff shown in phantom and without showing a frame)
Figure 14:
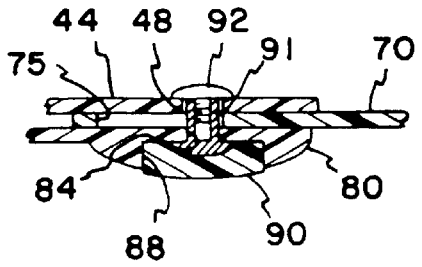
FIG. 14 is a view taken along line 14—14 of FIG. 13.

The attachment of the ends 80, 82 at holes 48, 50 is identical for both sides of the skate and a description with respect to end 80 will suffice as a description of end 82. The attachment is best shown in FIGS. 13 and 14 where a plug 90 (shown partially in phantom) is provided sized to be received within the recess 88 and with a sleeve 91 having an internal thread passed through hole 84, slot 76 and hole 48. A threaded bolt 92 is threaded into the interior of the sleeve 91. This method of attachment permits pivoting movement of the cuff 32 relative to the heel 30 and toe 34. Further, the connection permits relative sliding movement of the toe 34 relative to the heel portion 30 upon the loosening of nut 68.

A conventional buckle arrangement having a release fastener 96 secured to one side of cuff 32 and a tensioning buckle and strap 98 secured to the opposite side of cuff 32 is provided to permit the cuff 32 to be securely fastened to the leg of a wearer. Similarly, a like buckle arrangement having a tension strap and buckle 97 and a release fastener 102 are provided on opposite sides 70, 72 of the toe portion 34 to securely fasten the instep of the wearer's foot to the boot 12. Finally, a tongue 36 is provided as is conventional.

Figure 9:
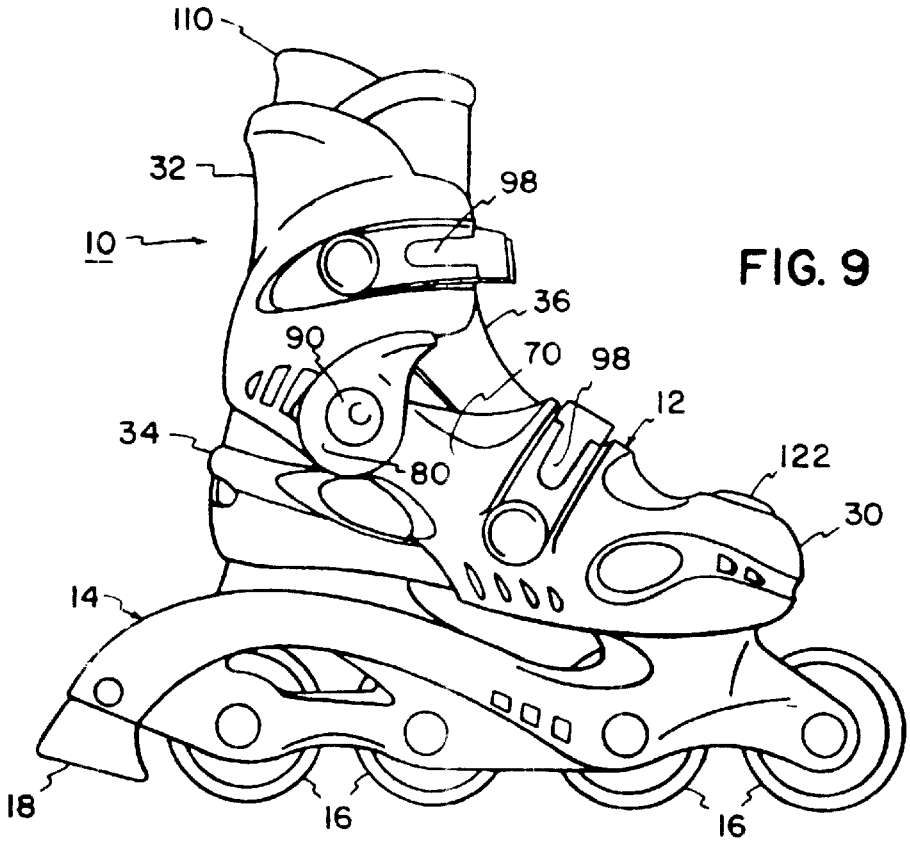
FIG. 9 is the view of FIG. 3 separately shown to compare with FIG. 10.
Figure 10:
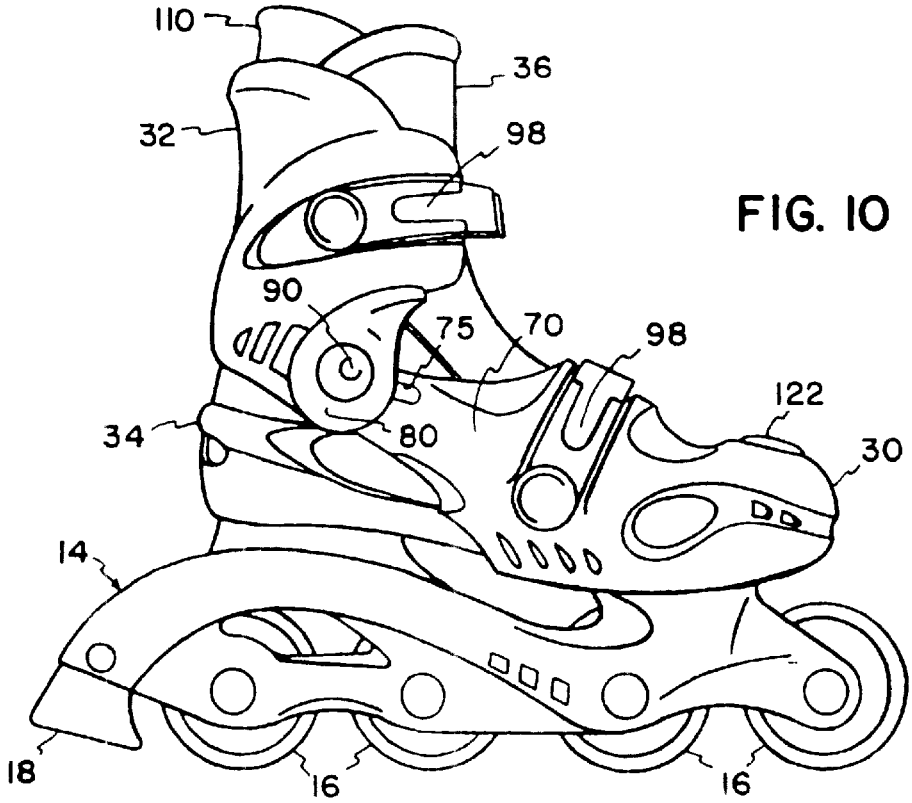
FIG. 10 is the view of FIG. 9 with the skate adjusted to a maximum foot size adjustment.

With the construction thus described, a wide variety of foot sizes can be accommodated by simply loosening nut 68 such that the toe portion 34 is moved relative to the heel portion 30. About four different foot sizes can be achieved by permitting a stroke of movement equal to about one inch. Accordingly, the slots 76, 78 will have a length of about one inch. Since a sliding adjustment is provided, unique adjustment is possible to accommodate unique foot sizes within a range between a minimum foot size (FIG. 9) and a maximum foot size (FIG. 10). Further, the foregoing design permits the use of a pivoting cuff 32 which has numerous advantages in the performance of in-line skating. Also, throughout the adjustment of the length, the positioning of the user's heel relative to the frame 14 and wheels 16 remains unchanged which presents a significant advantage in the performance of in-line skating since heel positioning is important to the performance of the skate.

Figure 8:
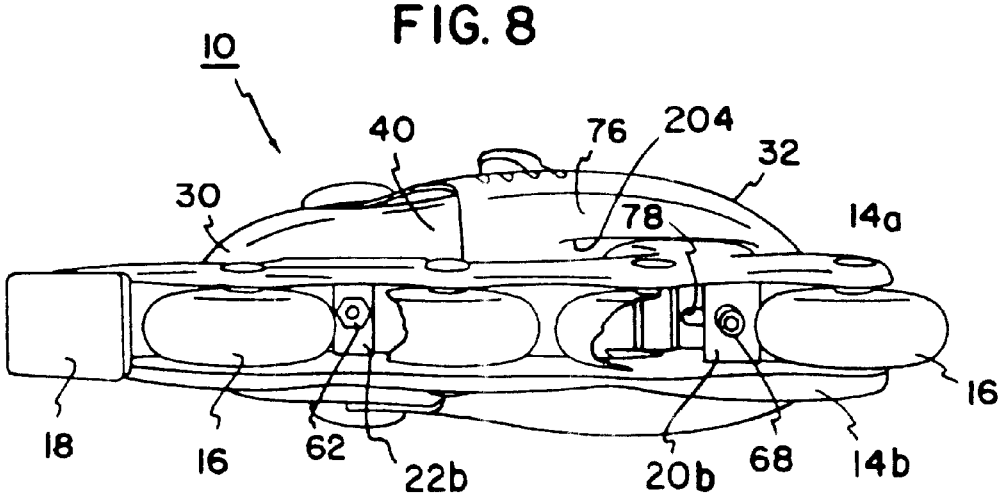
FIG. 8 is a bottom plan view of the skate of FIG. 1.

As appears from FIGS. 8 and 11, the front upper portion of frame 14 has a vertical side surface 202 that slides with respect a vertical surface 204 on the bottom of toe portion 34, thereby providing a channel on the underside of the toe portion 34 and a guide track for the toe portion as it is moved along the line of travel. These sliding surfaces 202, 204 resist lateral movement of the toe portion and transmit lateral forces from the toe section to the heel section and are spaced from fastening nut 68.

The present invention also utilizes a novel construction of a liner 110 (FIG. 2) to accommodate increases in shoe size. The use of resilient liners in inline skates is well known. The present liner 110 includes a toe portion 112 joined to the main body portion 114 by an expandable resilient section 116 positioned surrounding the instep area of the foot. Accordingly, the toe portion 112 may move relative to the main body portion 114. A lug 117 is provided on the toe portion 112. The lug 117 is secured to the upper wall 74 of the boot toe 34 by passing the lug 117 through a hole 118 formed in the upper surface 74 and securing the lug 117 in said position by a bolt or screw 120 (FIG. 12). The area surrounding the hole 118 is provided with a recess 121 to receive a decorative cap 122. Accordingly, as a user adjusts the size of the boot by expanding the toe portion 34 of the boot, the toe 112 of the skate liner 110 follows the toe 34 of the boot 12.

From the foregoing detailed description of the present invention, it has been shown how the objects of the invention have been attained in the preferred manner. However, modifications and equivalents of the disclosed concepts such as those which readily occur to one skilled in the art are intended to be included within the scope of the claims which are appended hereto.

What is claimed is:

1. An adjustable fit in-line skate comprising:

a frame having two spaced-apart, substantially parallel rails;

a plurality of in-line skate wheels secured between the rails of the frame, the in-line skate wheels including a front wheel mounted on a first axle, a front intermediate wheel trailing the front wheel and mounted on a second axle, a rear intermediate wheel trailing the front intermediate wheel and a rear wheel trailing the rear intermediate wheel;

a boot including a heel portion and a toe portion;

the toe portion being slidable relative to the heel portion along a line of travel generally parallel to a longitudinal axis of the skate;

the heel portion being attached at a longitudinal position relative to the frame; and a single fastening member releasably securing the toe portion to the frame in a desired longitudinal position relative to the heel portion.

2. The skate of claim 1, wherein the single fastening member is positioned at a location that trails the first axle and leads the second axle.

3. The adjustable fit in-line skate of claim 1, wherein the single fastening member extends through a frame opening defined by the frame at a location between the rails of the frame.

4. The adjustable fit in-line skate of claim 3, wherein the fastening member extends through an elongated opening defined by a base of the toe portion, the elongated opening being elongated in a direction generally parallel to the longitudinal axis of the skate.

5. The adjustable fit in-line skate of claim 1, wherein the fastening member is a bolt.

6. The adjustable fit in-line skate of claim 1, wherein the boot further includes a cuff portion pivotally connected to the heel portion.

7. The adjustable fit in-line skate of claim 1, wherein the heel portion includes a sole and side walls that are integrally connected as a single piece.

8. The skate of claim 1 wherein said fastening member is vertically oriented.

9. The skate of claim 1, wherein the heel portion is generally fixed longitudinally relative to the frame.

10. An adjustable fit in-line skate comprising:

a frame having substantially parallel rails;

a plurality of in-line skate wheels mounted between the rails, all said wheels of said skate being mounted on said frame;

a boot including a heel portion and a toe portion;

the toe portion being slidable relative to the heel portion along a line of travel generally parallel to a longitudinal axis of the skate, said toe portion being separate from said frame;

the heel portion being attached at a longitudinal position relative to the frame;

a fastening member releasably securing the toe portion in a desired longitudinal position to said frame relative to the heel portion; and said toe portion including a guide track for guiding the toe portion with respect to said frame as the toe portion is moved along the line of travel, wherein the guide track is spaced from the fastening member.

11. The adjustable fit in-line skate of claim 10, wherein the guide track is spaced from the fastening member.

12. The skate of claim 10, wherein the heel portion is generally fixed longitudinally relative to the frame.

13. An adjustable fit in-line skate comprising:

a frame having substantially parallel rails;

a plurality of in-line skate wheels mounted between the rails;

a boot including a heel portion and a toe portion, the heel portion including a sole;

the toe portion being slidable relative to the heel portion along a line of travel generally parallel to a longitudinal axis of the skate, said toe portion including a base, a top wall and sidewalls extending between the base and the top wall defining a partially enclosed region for receiving a user's toe;

the heel portion being attached at a longitudinal position relative to the frame;

a fastening member releasably securing the toe portion in a desired longitudinal position relative to the heel portion; and the sole of the heel portion extending into said partially enclosed region of said toe portion and being arranged and configured to resist lateral movement of the toe portion as the toe portion is slid relative to the heel portion.

14. The skate of claim 13, wherein the heel portion is generally fixed longitudinally relative to the frame.

15. An in-line roller skate comprising:

a boot having a boot toe section having a base, a top wall and sidewalls extending between the base and the top wall and a boot heel section, said boot toe section being slidable relative to said boot heel section along a longitudinal axis;

a first surface that is fixed in position with respect to said heel section;

a second surface that is fixed in position with respect to and moveable with said toe section as said toe section slides relative to said heel section, said second surface being in slidable contact with said first surface, said first and second surfaces being arranged so that said lateral forces exerted on said toe section are transmitted to said heel section through contact between said first and second surfaces; and at least one fastening member for securing said toe section relative to said heel section;

wherein each of said first surface and second surface is spaced from said at least one fastening member.

16. The in-line skate of claim 15, wherein there is a single fastening member.

17. The in-line skate of claim 16, wherein the fastening member is a bolt.

18. The in-line skate of claim 17, wherein said boot further comprises a generally horizontal footbed and said second surface extends vertically relative to said footbed.

19. The in-line skate of claim 18, wherein said second surface is defined by a contour member that is connected to said toe section.

20. The in-line skate of claim 18, wherein said first surface extends vertically relative to said footbed.

21. The skate of claim 15 wherein said fastening member is located on the toe portion.

* * * * *